United States Patent [19]

Yahata

[11] Patent Number: 4,982,223

[45] Date of Patent: Jan. 1, 1991

[54] DEVELOPER GUIDE FOR PREVENTING DEVELOPER FROM ENTERING GAP BETWEEN DEVELOPING SLEEVES

[75] Inventor: Masasumi Yahata, Yokohama, Japan

[73] Assignee: Ricoh Company, Ltd., Tokyo, Japan

[21] Appl. No.: 450,470

[22] Filed: Dec. 14, 1989

[30] Foreign Application Priority Data

Dec. 19, 1988 [JP] Japan ..... 63-164106[U]
Nov. 3, 1989 [JP] Japan ..... 1-286900

[51] Int. Cl.[5] ..... G03G 15/09

[52] U.S. Cl. ..... 355/251; 118/658; 355/253

[58] Field of Search ..... 118/656, 657, 658; 355/245, 251, 253

[56] References Cited

U.S. PATENT DOCUMENTS

| | | | |
|---|---|---|---|
| 4,041,903 | 8/1977 | Katakura et al. | 118/658 |
| 4,235,193 | 11/1980 | Groen et al. | 118/658 |
| 4,766,458 | 8/1988 | Oka et al. | 355/251 |
| 4,912,511 | 3/1990 | Murasaki | 355/245 |

FOREIGN PATENT DOCUMENTS

| | | | |
|---|---|---|---|
| 0089873 | 7/1980 | Japan | 355/251 |
| 0116669 | 7/1984 | Japan | 355/251 |
| 0226366 | 12/1984 | Japan | 355/253 |
| 0115972 | 6/1985 | Japan | 355/251 |
| 0179766 | 9/1985 | Japan | 355/251 |

*Primary Examiner*—Arthur T. Grimley
*Assistant Examiner*—William J. Royer
*Attorney, Agent, or Firm*—Oblon, Spivak, McClelland, Maier & Neustadt

[57] ABSTRACT

A developing device for an image forming apparatus having a plurality of developing sleeves which are arranged one above the other in a predetermined relationship along the surface of an image carrier of the apparatus, and developing a latent image electrostatically formed on the image carrier by using a toner contained in a developer. While a paddle wheel scoops up the developer, a developer guide guides the scooped developer to the uppermost developing sleeve. The developer fed by the paddle wheel toward the lowermost developing sleeve is received by the guide member and driven therealong to the uppermost developing sleeve and not to the lowermost sleeve.

5 Claims, 4 Drawing Sheets

DEVELOPER GUIDE FOR PREVENTING DEVELOPER FROM ENTERING GAP BETWEEN DEVELOPING SLEEVES

BACKGROUND OF THE INVENTION

The present invention relates to a developing device for use in an image forming apparatus and of the type having a plurality of developing sleeves arranged one above the other in a predetermined relationship along the surface of a latent image carrier which is included in the image forming apparatus. This type of developing device develops a latent image electrostatically formed on the image carrier by using a toner contained in a developer which is fed to the developing sleeves.

An electrophotographic copier, facsimile machine, laser printer or similar image forming apparatus electrostatically forms a latent image on a photoconductive element or similar image carrier and develops the latent image to render it visible. This kind of apparatus has a developing device which is often implemented with a two-component powdery developer, i.e., a mixture of toner and carrier. The developing device usually has a single developing sleeve located to face the photoconductive element, and a paddle wheel serving as a means for supplying the developer to the photoconductive element. The photoconductive element and the developing sleeve rotate in the same direction in a developing region where they face each other. Assuming that the linear velocities of the photoconductive element and developing sleeve are Vp and Vs, respectively, the ratio Vs/Vp is ordinarily selected to be 3 or above. Specifically, the linear speed of the developing sleeve is selected to be far higher than that of the photoconductive element, so that an amount of developer great enough to produce a toner image having a predetermined density may be fed to the developing region. Such a relationship between the photoconductive element and the developing sleeve is disclosed in Japanese Patent Laid-Open Publication (Kokai) No. 58-207064, for example. This, however, brings about a problem that providing a vertical and a horizontal thin line image extending respectively in the rotating direction and the axial direction of the photoconductive element with a predetermined width is difficult. Another problem is that when a cruciform image is formed on the photoconductive element, trailing end portions of the image with respect to the rotating direction of the photoconductive element, i.e., the moving direction of its surface are often lost and left blank on a paper sheet.

Another type of developing device extensively used today has a plurality of developing sleeves, such as two developing sleeves, arranged one above the other along the surface of the photoconductive element. In this type of developing device, a paddle wheel supplies a developer to the developing sleeves, while a separator and a doctor regulates the amount of developer being supplied by the paddle wheel. Assume that the two developing sleeves are rotated at the same linear velocity of Vs, and the photoconductive element is rotated at a linear velocity Vp. Then, even if the ratio Vs/Vs is as small as 1.5 or so, a sufficient amount of developer can be fed to the developing regions where the individual developing sleeves are located. This is successful in uniformizing the widths of vertically extending and horizontally extending thin line images on the photoconductive element and in eliminating the local omission of a cruciform image as mentioned previously.

However, such a multiple sleeve scheme gives rise to another problem, as follows.

The upper and lower developing sleeves are spaced apart from each other by a gap of about 1 millimeter. The gap causes a part of the developer fed by the paddle wheel to be directly transported to the photoconductive element therethrough. Consequently, the amount of developer to be fed to the upper sleeve by the separator and doctor is reduced and, hence, the amount of developer passing the doctor becomes unstable. The developer conveyed toward the photoconductive element through the gap is fed only to the developing region where the lower sleeve is located and not to the developing region where the upper sleeve is located. When a substantial amount of developer flows through the gap, it will accumulate at the upstream side of the developing region where the lower sleeve is disposed and exert, in due course, a substantial load on the photoconductive element and developing sleeves. Such a load is apt to prevent the photoconductive element and the developing sleeves from being rotated at their predetermined speeds. The developer flowing through the gap and not through the separator and doctor is not stressed and, therefore, fails to have its toner and carrier sufficiently charged. It is, therefore, likely that the toner particles are released from the carrier and deposited on the photoconductive element, contaminating the background area on the photoconductive element. Further, such floating toner particles are apt to smear the interior of the image forming apparatus. In any case, the developer flowing through the gap obstructs stable development. To eliminate this problem, a developer supply sleeve having magnets thereinside may be located above the paddle wheel and in close proximity to the upper developing sleeve. In this case, the developer will be fed by the paddle wheel to the upper developing sleeve by way of the developer supply sleeve and not through the gap. However, the developer supply sleeve accommodating magnets thereinside would increase the overall dimensions of the developing device and thereby the production cost thereof.

SUMMARY OF THE INVENTION

It is therefore an object of the present invention to provide a developing device for an image forming apparatus which eliminates the drawbacks particular to the prior art as discussed above with a simple construction.

It is another object of the present invention to provide a developing device for an image forming apparatus which makes most of the merits of a multiple developing sleeve scheme and, yet, prevents a developer from entering the gap between the sleeves.

It is another object of the present invention to provide a generally improved developing device for an image forming apparatus.

A developing device for an image forming apparatus for developing a latent image electrostatically formed on an image carrier by using a developer of the present invention comprises a plurality of developing sleeves located one above the other in a predetermined relationship along the surface of the image carrier and rotatable in the same direction as a moving direction of the image carrier in individual developing regions where the developing sleeves face the surface of the image carrier, magnets fixed in place within each of the developing sleeves for retaining the developer on the surface of associated one of the developing sleeves by magnetism, a developer supplying member located in a position where the developer supplying member is capable of supplying the developer to lowermost one of the developing sleeves, and a developer guide for guiding the developer supplied by the developer supplying member to uppermost one of the developing sleeves.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
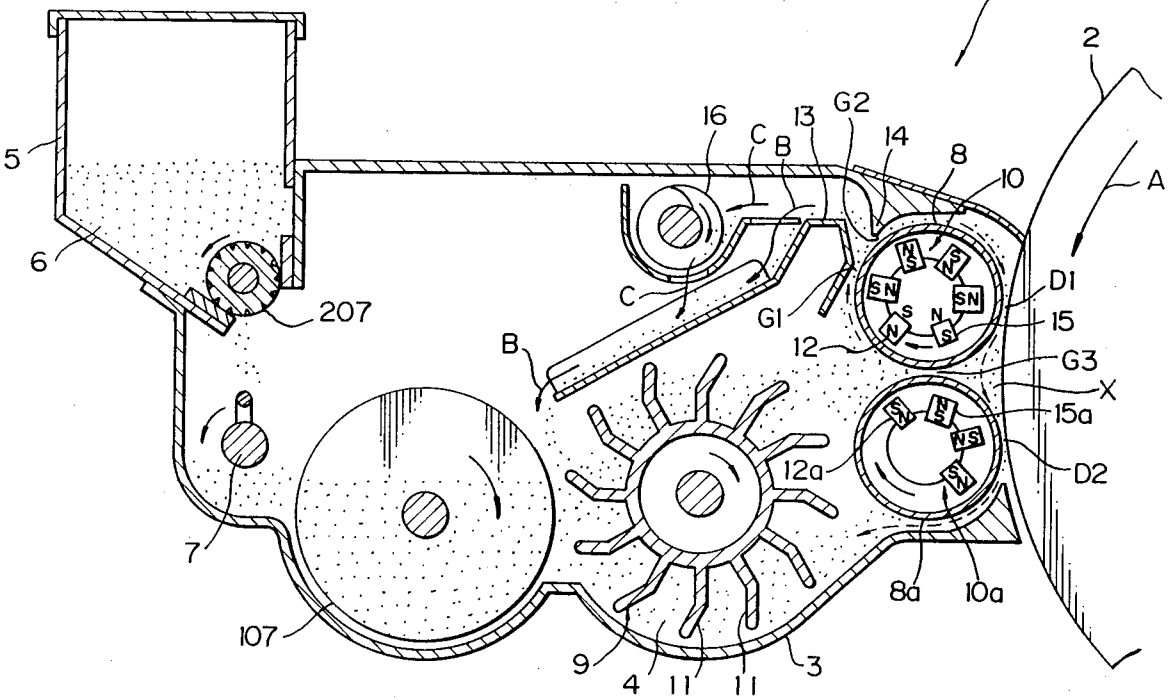
Fig. 1 PRIOR ART
FIG. 1 is a section showing a prior art developing device.

To better understand the present invention, a brief reference will be made to a prior art developing device, shown in FIG. 1. The prior art developing device, generally 1, is located in the vicinity of a photoconductive element in the form of a drum 2 which is a specific form of an image carrier. A powdery developer 4 made up of a magnetic carrier and a magnetic or non-magnetic toner is accommodated in a developing case 3. When the toner concentration in the developer 4 is lowered, a toner supply roller 207 is rotated to supply a fresh toner 6 from a toner container 5 to the developer 4. Agitating rollers 7 and 107 are disposed in the developing case 3 for agitating the fresh toner 6 introduced into the developer 4. A plurality of developing sleeves, two sleeves 8 and 8*a* in this case, and a paddle wheel 9 are rotatablly supported in the developing case 3. The paddle wheel 9 is a specific form of a rotatable developer drawing member. Each of the developing sleeves 8 and 8*a* is implemented as a cylinder made of a non-magnetic material. These sleeves 8 and 8*a* are positioned one above the other in a predetermined relationship along the surface of the drum 2. In the specific configuration shown in FIG. 1, the developing sleeve 8 is positioned above the developing sleeve 8*a*. Both the developing sleeves 8 and 8*a* are rotated clockwise as viewed in the figure by a drive mechanism, not shown. Magnet assemblies 10 and 10*a* are fixed in place within the developing sleeves 8 and 8*a*, respectively. Each of the magnet assemblies 10 and 10*a* is composed of a plurality of magnets whose ends that face the associated sleeve 8 or 8*a* are magnetized to opposite polarities alternately, as represented by alphabets S and N in the figure.

Made of aluminum, for example, the paddle wheel 9 has a cylindrical hub and a number of blades 11 extending radially outward from the hub. The paddle wheel 9 is rotated clockwise as viewed in FIG. 1. Hence, the developer 4 in the developing case 3 is scooped up by the blades 11 while being agitated. The developer 4 so scooped up is released toward the lower developing sleeve 8*a* and thereby deposited on the surface of the sleeve 8*a*. Stated another way, the paddle wheel 9 is so positioned as to draw the developer 4 and feed it to the lowermost developing sleeve 8*a*. The drum 2 is rotated counterclockwise as indicated by an arrow A in the figure while an electrostatic latent image is formed on the drum 2. In FIG. 1, the latent image on the drum 2 moves downward at a position where the drum 2 adjoins the developing device 1.

The developer fed to the lower developing sleeve 8*a* as stated above is attracted by and handed over to the upper developing sleeve 8 due to two magnets 12 and 12*a* which are respectively accommodated in the sleeves 8 and 8*a* and face each other. The developer transferred from the lower sleeve 8*a* to the upper sleeve 8 is retained on the periphery of the sleeve 8 by the magnet assembly 10 and is transported clockwise as the sleeve 8 rotates. After the developer on the sleeve 8 has moved through a separator gap G1 defined between a separator 13 and the sleeve 8, a doctor 14 scrapes an excessive part of the developer off the sleeve 8. Consequently, an adequate amount of developer for development is moved through a doctor gap G2 between the doctor 14 and the sleeve 8. This part of the developer is further transported clockwise while forming a magnet brush, due to the magnetic force of the magnet assembly 10 and the rotation of the sleeve 8. Then, the developer in the form of a magnet brush arrives at a first developing region D1 where the sleeve 8 and drum 2 face each other. The developer having moved away from the developing region D1 is handed over to the lower sleeve 8*a* by the force of two magnets 15 and 15*a* which are respectively accommodated in the sleeves 8 and 8*a* and face each other. This part of the developer handed over to the sleeve 8*a* is transported through a second developing region D2 where the sleeve 8*a* faces the drum 2. Finally, the developer is released from the sleeve 8*a* to the bottom of the developing case 3 and agitated by the paddle wheel 9 there.

In the developing regions D1 and D2, the developing sleeves 8 and 8*a* each rotates in the same direction as the moving direction of the drum 2. The direction in which the developer is transported is indicated by dotted arrows. While the developer is so transported, it is agitated by the paddle wheel 9 and stressed by the gaps G1 and G2. Hence, the toner and carrier particles of the developer rub themselves against each other and are thereby charged to opposite polarities, whereby the toner particles are electrostatically deposited on the carrier particles. When the developer on each of the sleeves 8 and 8*a* is brought to the associated developing region G1 or G2, the toner of the developer is electrostatically transferred to a latent image having been formed on the drum 2 so as to develop it. On the other hand, a part of the developer scraped off by the doctor 14 flows on and along the separator 13 and drops onto the paddle wheel 9 (arrow B), while the rest flows toward a screw member 16 which is rotating. The screw member 16 conveys the incoming developer in a direction perpendicular to the sheet surface of FIG. 1 while agitating it, until the developer drops onto the paddle wheel 9 via the separator 13 (arrow C). This also promotes the frictional charging of the toner and carrier particles.

Figure 2:
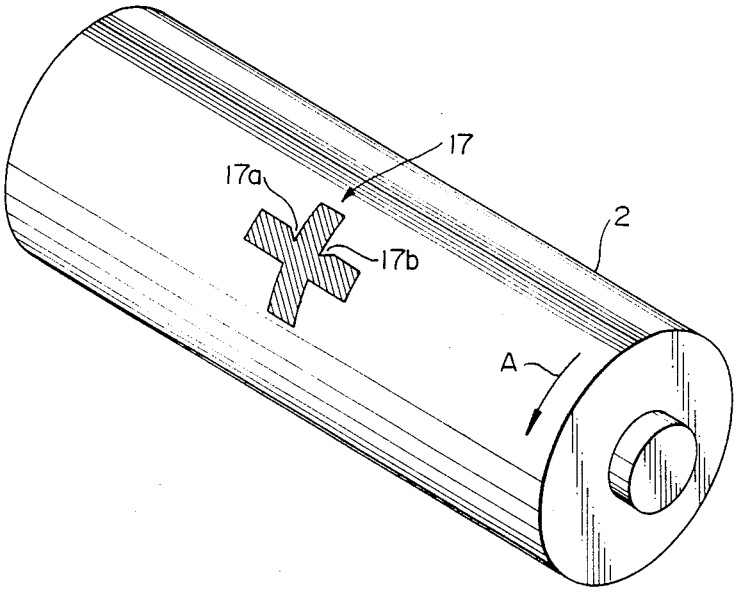
FIG. 2 is a view useful for understanding local omission of a cruciform image.

Apart from the developing device 1 shown in FIG. 1, there is also extensively used a developing device of the type having the lower developing sleeve 8*a* (FIG. 1) only. In this type of developing device, assuming that the linear velocities of the photoconductive element and developing sleeve are Vp and Vs, respectively, it is necessary to select a ratio Vs/Vp of about 3 or greater ratio, for example. Specifically, the linear speed of the developing sleeve has to be far higher than that of the photoconductive element. Otherwise, the amount of developer being fed to the developing region would become short to lower the density of a toner image beyond a predetermined level (see, for example, Japanese Patent Laid-Open Publication No. 58-207064 mentioned earlier). However, when the photoconductive element and developing sleeve are moved in the same direction in the developing region, providing a vertical and a horizontal thin line image formed on the photoconductive element with a predetermined width is difficult, as discussed previously. Further, assume that a cruciform image 17 is formed on the drum 2, as shown in FIG. 2. Then, the trailing end portions 17*a* and 17*b* of the cross with respect to the rotating direction A of the drum 2 are lost resulting in the image quality being degraded.

In contrast, when use is made of two or more developing sleeves such as 8 and 8*a* as shown in FIG. 1, sufficient image density is insured even if the ratio Vs/Vs is reduced to 1.5 or so. By so reducing the ratio Vs/Vp, the widths of vertically extending and horizontally extending thin line images on the photoconductive element are uniformized and the local omission of a cruciform image is eliminated, despite that the sleeves 8 and 8*a* move in the same direction as the drum 2 in the individual developing regions D1 and D2.

However, the multiple sleeve scheme stated above has the following problem. Specifically, the upper and lower developing sleeves 8 and 8*a* should not be held in contact with each other and are spaced apart from each other by a gap G3 of about 1 millimeter, for example. The gap G3 causes a part of the developer fed by the paddle wheel 9 to be directly transported to the photoconductive element 2 therethrough as the lower sleeve 8*a* is rotated. Consequently, the amount of developer to be handed over to the upper sleeve 8 is reduced and, hencè, the amount of developer being scraped off by the doctor 14 and flowing toward the separator 13 (hereinafter referred to as a recirculated amount) is reduced. This in turn renders the amount of developer passing through the doctor gap G2 unstable, resulting in poor image quality. The developer moved away from the gap G3 is fed only to the developing region D2 and not to the developing region D1. As a result, the amount of developer passing through the developing region D1 becomes smaller than the amount of developer passing through the other developing region D2, whereby the image quality is delicately effected.

When a substantial amount of developer flows through the gap G3, it will accumulate in the the developing region D2 or a position X slightly upstream of the region D2. As the amount of accumulation increases, a substantial load acts on the drum 2 and developing sleeves 8 and 8*a*. Such a load is apt to prevent the drum 5 and developing sleeves 8 and 8*a* from rotating at their predetermined speeds. In the worst case, the load will practically stop the movement of the drum 5 and sleeves 8 and 8*a* to prevent an image from being formed. The developer flowing through the gap G3 has been agitated by the paddle wheel 9, but it has not been routed through the separator gap G1 and doctor gap G2. This part of the developer, therefore, has not been sufficiently stressed, and the toner and carrier contained therein has not been sufficiently charged. It is, therefore, likely that the toner particles are released from the carrier and deposited on the drum 5, contaminating the background area on the photoconductive element. Further, such floating toner particles are apt to fly out of the developing case 3 to smear the interior of the image forming apparatus 1.

It is true that the magnets 12 and 12*a* facing each other are provided in the developing sleeves 8 and 8*a*, respectively, in order to transfer all the developer from the lower sleeve 8*a* to the upper sleeve 8. Such an implementation alone, however, cannot fully intercept the developer which tends to enter the gap G3. Further, arranging the magnets in such a manner as to restrain the entry of the developer into the gap G3 reduces the design freedom of the entire developing device.

In the light of the above, a developer supply sleeve having magnets thereinside may be located above the paddle wheel 9 and in close proximity to the upper developing sleeve 8. In this case, the developer will be fed by the paddle wheel 9 to the upper sleeve 8 by way of the developer supply sleeve. Since the developer is prevented from being directly fed to the lower sleeve 8*a* by the paddle wheel 9, it will not enter the gap G3 between the upper and lower sleeves 8 and 8*a*. However, the developer supply sleeve accommodating magnets thereinside would increase the overall dimensions of the developing device and thereby the production cost, as discussed earlier.

Figure 3:
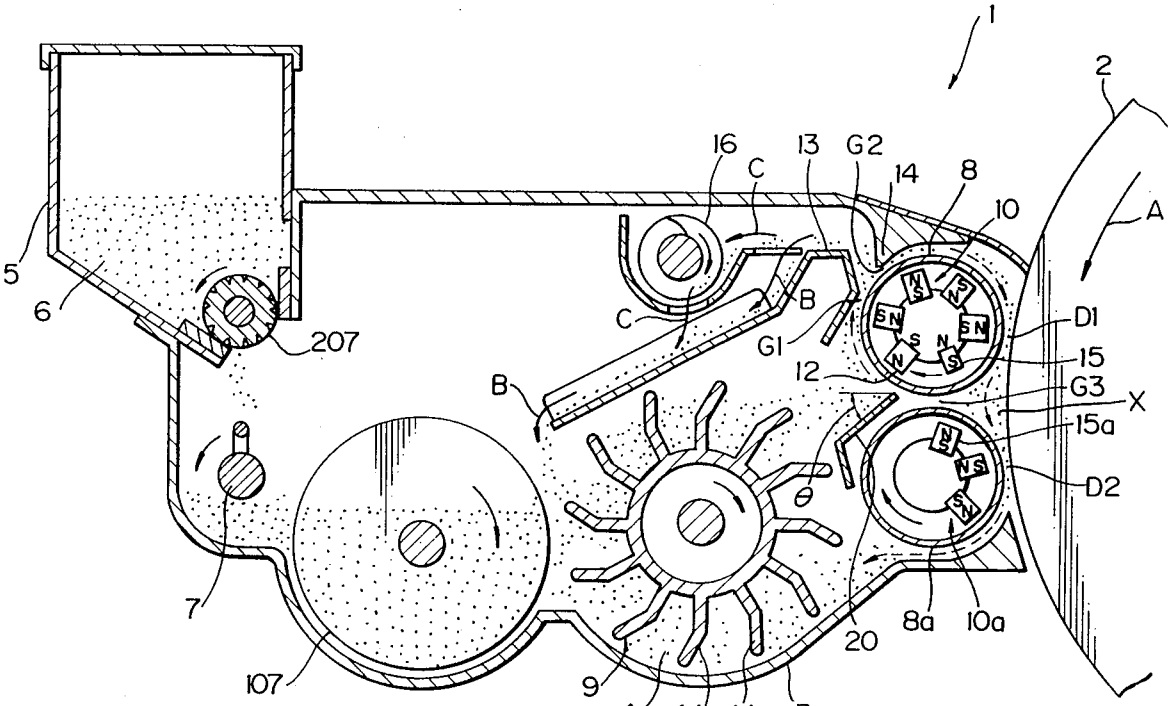
FIG. 3 is a section showing a developing device embodying the present invention.

Referring to FIG. 3, a developing device embodying the present invention is shown which is free from the drawback stated above. In the figures, the same components and structural elements are designated by like reference numerals, and redundant description will be avoided for simplicity. The embodiment shown in FIG. 3 is essentially similar to the prior art of FIG. 1 as far as the basic construction is concerned.

The embodiment shown in FIG. 3 is distinguishable over the prior art in that it has a developer guide 20 and does not have the magnet 12*a* heretofore disposed in the lower developing sleeve 8*a*. The developer guide 20 guides the developer 4 drawn by the paddle wheel 9 toward the upper developing sleeve 8. Specifically, the developer guide 20 is implemented as a non-magnetic plate which extends in an inclined position from a position above and rightward of the paddle wheel 9 to a position below and leftward of the upper developing sleeve 8. More specifically, the upper end of the developer guide 20 is located in close proximity to the periphery of the upper sleeve 8, while the lower end is located in close proximity to the paddle wheel 9. The developer guide 20 faces and extends over the entire length of the lower sleeve 8*a* and is securely mounted on opposite side walls of the developing case 3.

In operation, the developer 4 released from the paddle wheel 9 toward the lower developing sleeve 8*a* is received by the developer guide 20. The developer 4 on the lower sleeve 8*a* is attracted by the magnet 12 which is accommodated in the upper sleeve 8 and is thereby transferred to the upper sleeve 8. Thereafter, the developer 4 is transported by the upper sleeve 8 as indicated by dotted arrows, i.e., it is routed through the successive gaps G1 and G2 and successive developing regions D1 and D2 in exactly the same manner as in the prior art developing device. While the developer sequentially passes the developing regions D1 and D2, it develops a latent image having been formed on the drum 2. After the development, the developer 4 is released from the lower sleeve 8*a*.

In the above construction, the developer drawn by the paddle wheel 9 is directly fed to the upper developing sleeve 8 by the developer guide 20 and prevented from entering the gap G3 between the upper and lower sleeves 8 and 8a. Hence, there is no chance for the developer to be allowed into the gap G3, so that all the problems ascribable to the developer entering the gap G3 as described previously are eliminated. Specifically, the amount of developer moving through the doctor gap G2 is maintained constant to enhance the quality of a toner image, while the amounts of developer moving through the two developing regions D1 and D2 are uniformized to insure desired image quality. There is no fear that a substantial amount of developer accumulates in the region X to effect the rotation of the drum 2 and sleeves 8 and 8a, and that floating toner particles contaminate the background area of the drum 5 while being scattered around. The developer guide 20 replaces a bulky and expensive developer supply sleeve having magnets thereinside heretofore used. This, coupled with the fact that the lower sleeve 8 does not need the magnet 12a, cuts down the cost of the developing device. Thus, the illustrative embodiment makes the most of the merits of the multiple developing sleeve scheme despite the simple construction.

Preferably, the blades 11 of the paddle wheel 9 are each bent frontward with respect to the rotating direction of the paddle wheel 9, as in the prior art shown in FIG. 1. Such a configuration of the blades 11 allows a large amount of developer to be fed effectively to the developer guide 20. The angle $\theta$ of the developer guide 20 to the horizontal is advantageously selected to be 40 degrees to 50 degrees so as to readily receive the developer.

Figure 4:
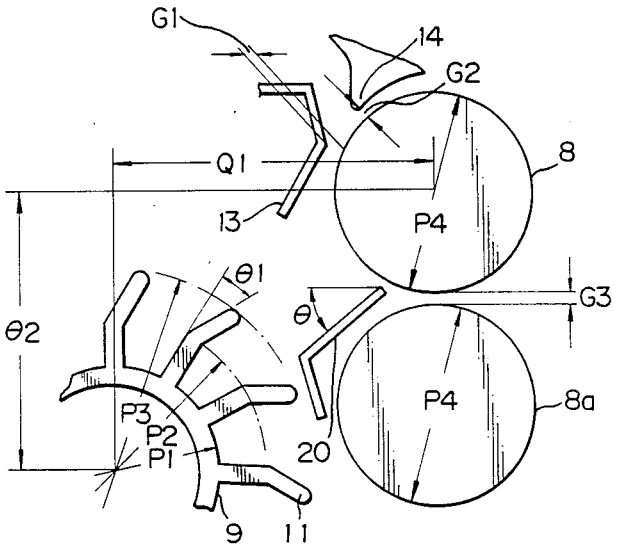
FIG. 4 is a view showing specific dimensions and other similar factors of various components of the device depicted in FIG. 3.

FIG. 4 shows specific dimensions of a developing apparatus with which the present invention was practiced for experiment. As shown, the cylindrical hub of the paddle wheel 9 had an outside diameter P1 of 20 millimeters; each blade 11 of the paddle wheel 9 was bent at a diameter P2 of 30 millimeters; the tip of each blade 11 was positioned at a diameter P3 of 40 millimeters; and each blade 11 was bent at an angle $\theta 1$ of 30 degrees. The upper and lower developing sleeves 8 and 8a had an outside diameter P4 of 20 millimeters; the gap G3 between the sleeves 8 and 8a was 1 millimeter; the sleeves 8 and 8a were rotated at a speed of 650 revolutions per minute; the separator gap G1 was 1.5 millimeters; and the doctor gap G2 was 0.55 millimeter. The center of the upper sleeve 8 and that of the paddle wheel 9 were spaced apart from each other by a distance Q1 of 32 millimeters as measured in the horizontal direction and by a distance Q2 of 28 millimeters as measured in the vertical direction. Further, the linear velocity ratio Vs/Vp of the sleeves 8 and 8a was selected to be 1.5.

Figure 5:
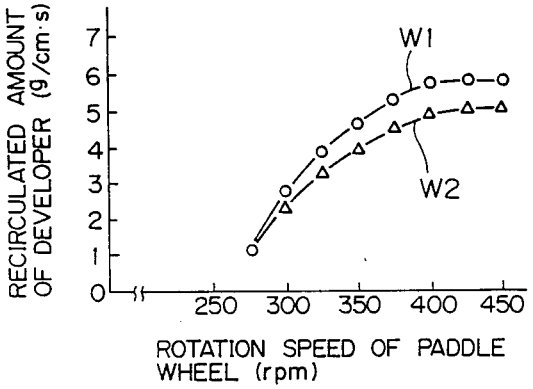
FIG. 5 is a graph representative of a specific relationship between the rotation speed of a paddle wheel and the amount of recirculation of a developer.

Under the above conditions, the paddle wheel 9 was rotated at various speeds to determine a relationship between the amount of developer scraped off the doctor 14 and caused to flow toward the separator 13, i.e., the recirculated amount and the rotation speed of the paddle wheel 9. FIG. 5 is a graph representative of the determined relationship. In FIG. 5, curves W1 and W2 indicate respectively a result obtained with the developer guide 20 shown in FIGS. 3 and 4 and a result obtained without the developer guide 20. It will be seen that the developer guide 20 serves to increase the recirculated amount, i.e., to prevent the developer from entering the gap G3 between the sleeves 8 and 8a. When the developer guide 20 is absent, the recirculated amount decreases due to the entry of the developer into the gap G3.

While the illustrative embodiment has been shown and described in relation to two developing sleeves, the present invention is of course applicable to a developing device having three or more developing sleeves. All that is required is arranging a developer guide such that a developer scooped up by a rotatable developer drawing member, which is located at a position where it is capable of supplying the developer to the lowermost developing sleeve, is guided toward the uppermost developing sleeve. The present invention is practicable not only with an image carrier in the form of a drum as shown and described but also with an image carrier in the form of a belt.

In summary, it will be seen that the present invention provides a developing device which intercepts a developer that tends to enter a gap defined between an upper and a lower developing sleeve by using an inexpensive and small developer guide. This is successful in making the most of the merits inherent in the multi-sleeve scheme.

Various modifications will become possible for those skilled in the art after receiving the teachings of the present disclosure without departing from the scope thereof.

What is claimed is:

1. A developing device for an image forming apparatus for developing a latent image electrostatically formed on an image carrier by using a developer, comprising:

a plurality of developing sleeves located one above the other in a predetermined relationship along a surface of the image carrier and rotatable in a same direction as a moving direction of said image carrier in individual developing regions where said developing sleeves face said surface of said image carrier, the plurality of developing sleeves including at least an uppermost developing sleeve and a lowermost developing sleeve which are spaced from one another by at least a gap;

magnets fixed in place within each of said developing sleeves for retaining the developer on a surface of associated one of said developing sleeves by magnetism;

developer supply means located in a position where said developer supplying means is capable of supplying the developer to said developing sleeves; and developer guiding means for guiding the developer supplied by the developer supply means to the uppermost one of said developing sleeves and for preventing the developer from entering the gap between said uppermost and lowermost sleeves.

2. A developing device as claimed in claim 1, wherein the developer comprises a two-component developer composed of a magnetic carrier and a magnetic or non-magnetic toner.

3. A developing device as claimed in claim 1, wherein said developing supplying means comprises a rotatable body in the form of a paddle wheel for scooping up the developer.

4. A developing device as claimed in claim 1, wherein said developer guiding means comprises a non-magnetic plate-like developer guide.

5. A developing device according to claim 4, wherein the nonmagnetic plate-like developer guide extends at an inclined position from above and adjacent the developer supply means to a position below and adjacent the lowermost one of said developing sleeves.

* * * * *